US007331121B2

(12) United States Patent
Lo

(10) Patent No.: US 7,331,121 B2
(45) Date of Patent: Feb. 19, 2008

(54) INFLATABLE SHOE SOLE

(76) Inventor: Chie-Fang Lo, No. 11, Alley 7, Lane 715, Dong Ping Rd., Taichung (TW)

( * ) Notice: Subject to any disclaimer, the term of this patent is extended or adjusted under 35 U.S.C. 154(b) by 432 days.

(21) Appl. No.: 11/037,349

(22) Filed: Jan. 19, 2005

(65) Prior Publication Data

US 2006/0156575 A1 Jul. 20, 2006

(51) Int. Cl.
*A43B 7/06* (2006.01)

(52) U.S. Cl. ..... 36/3 R; 36/3 B

(58) Field of Classification Search ..... 36/3 R, 36/3 B, 29, 25 R

See application file for complete search history.

(56) References Cited

U.S. PATENT DOCUMENTS 5,295,313 A * 3/1994 Lee ..... 36/3 R
5,477,626 A * 12/1995 Kwon ..... 36/3 B
5,975,861 A * 11/1999 Shin et al. ..... 417/234
6,085,444 A * 7/2000 Cho ..... 36/3 B
2003/0188451 A1* 10/2003 Wu ..... 36/3 B
2004/0010939 A1* 1/2004 Liu et al. ..... 36/29
2004/0020076 A1* 2/2004 Liu ..... 36/3 R
2004/0221481 A1* 11/2004 Regen ..... 36/3 B
2005/0005473 A1* 1/2005 Oh ..... 36/29
2005/0183286 A1* 8/2005 Crary ..... 36/3 B
2006/0143943 A1* 7/2006 Cho et al. ..... 36/3 B

* cited by examiner

*Primary Examiner*—Marie Patterson

(57) ABSTRACT

A shoe sole includes a chamber which is inflated by a pumping device via a connection tube. The connection tube includes a first valve to prevent air from flowing back into the pumping device and an inlet tube extends from the pumping device to introduce air from outside into the pumping device. A plurality of outlets are defined in a distal end of the connection tube and located corresponding to toes of the wearer. The connection tube has a neck portion which defines a narrowed path in the connection tube so that air is stopped at the neck portion to inflate the chamber, when the pressure of the air reaches to a pre-decided value, air passes through the neck portions and blows out from the outlets to cool the toes of the wearers.

5 Claims, 9 Drawing Sheets

INFLATABLE SHOE SOLE

FIELD OF THE INVENTION

The present invention relates to an inflatable shoe sole that allows air to inflate the sole so as to provide cushion and comfort to the wearers.

BACKGROUND OF THE INVENTION

In order to provide a wearer a comfortable wearing experience, a cushion pad or sole is used in shoes and the sole can be compressed by the load of the wearer so as to absorb shocks during walking or jogging. Most of the shoe soles are made of foam material which has less flexibility and cannot bounce quickly so that during jogging, the foam material is kept in a flat status which cannot absorb shocks as expected. Besides, most of the shoes do not have satisfied ventilation feature so that sweater is kept in the shoes and makes the wearers feel not comfortable.

The present invention intends to provide a shoe sole that includes a chamber and a pumping device for introducing air into the chamber so that the sole is soft and responses quickly to changing loads to the sole.

SUMMARY OF THE INVENTION

The present invention relates to an inflatable shoe sole which comprises a chamber, a pumping device and a connection tube which is in communication with the chamber and the pumping device. An inlet tube extends from the pumping device so as to introduce air from outside into the pumping device. An outlet tube extends from the pumping device and is located in the chamber so as to introduce air from the pumping device into the chamber. A first valve is received in the connection tube so as to prevent air from flowing back into the pumping device. The connection tube has a neck portion which defines a narrowed path in the connection tube. A plurality of outlets are defined in a distal end of the connection tube and the neck portion is located between the pumping device and the outlets.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1-1 shows a cross section al view of one of the sub-chambers of the inflatable shoe sole of the present invention;

FIG. 1-2 is a perspective view of one of the sub-chambers of the inflatable shoe sole of the present invention;

FIG. 2 is a top view of the inflatable shoe sole of the present invention;

DETAILED DESCRIPTION OF THE PREFERRED EMBODIMENT

Figure 1:
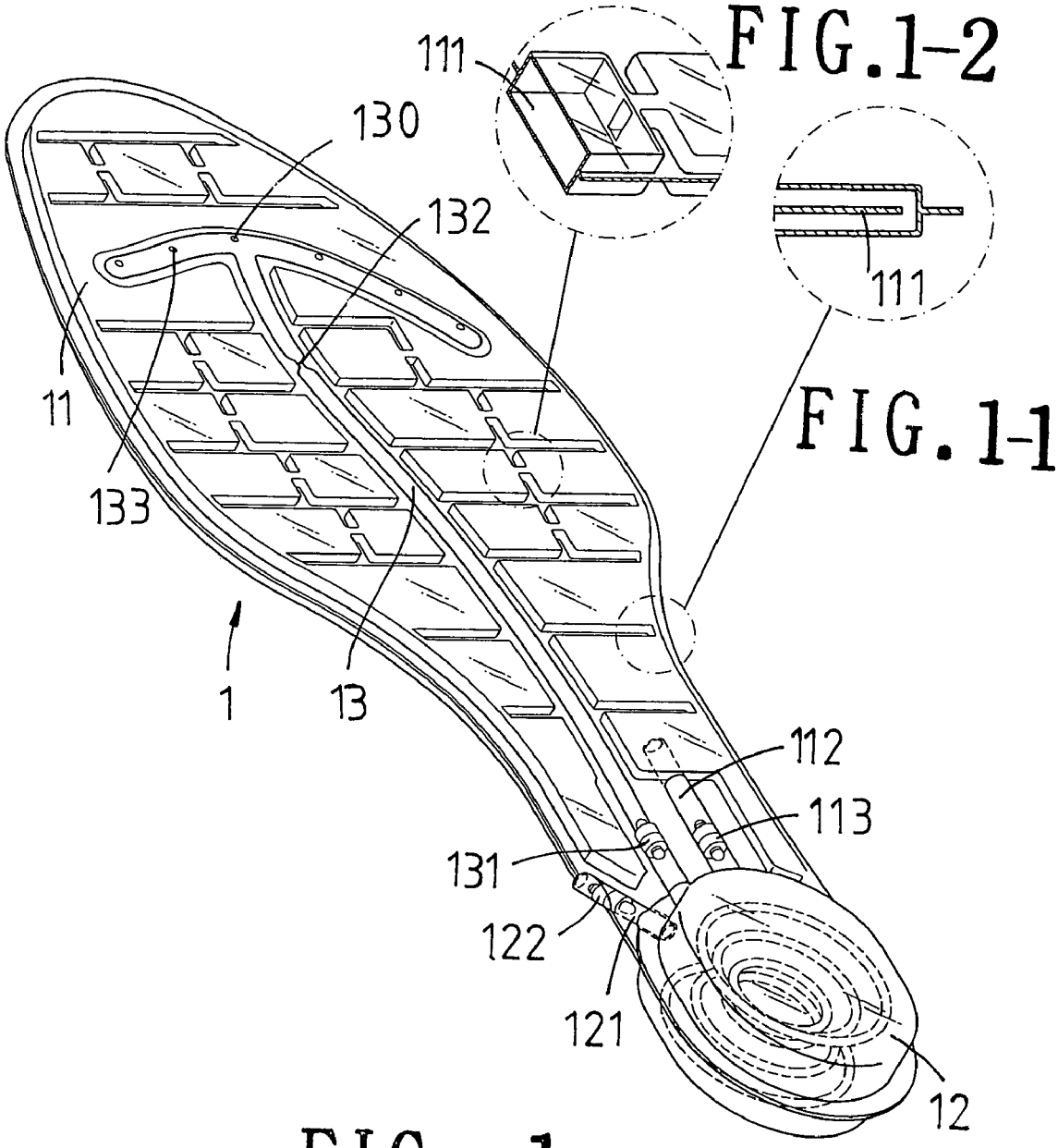
FIG. 1 shows the inflatable shoe sole of the present invention.
Figure 2:
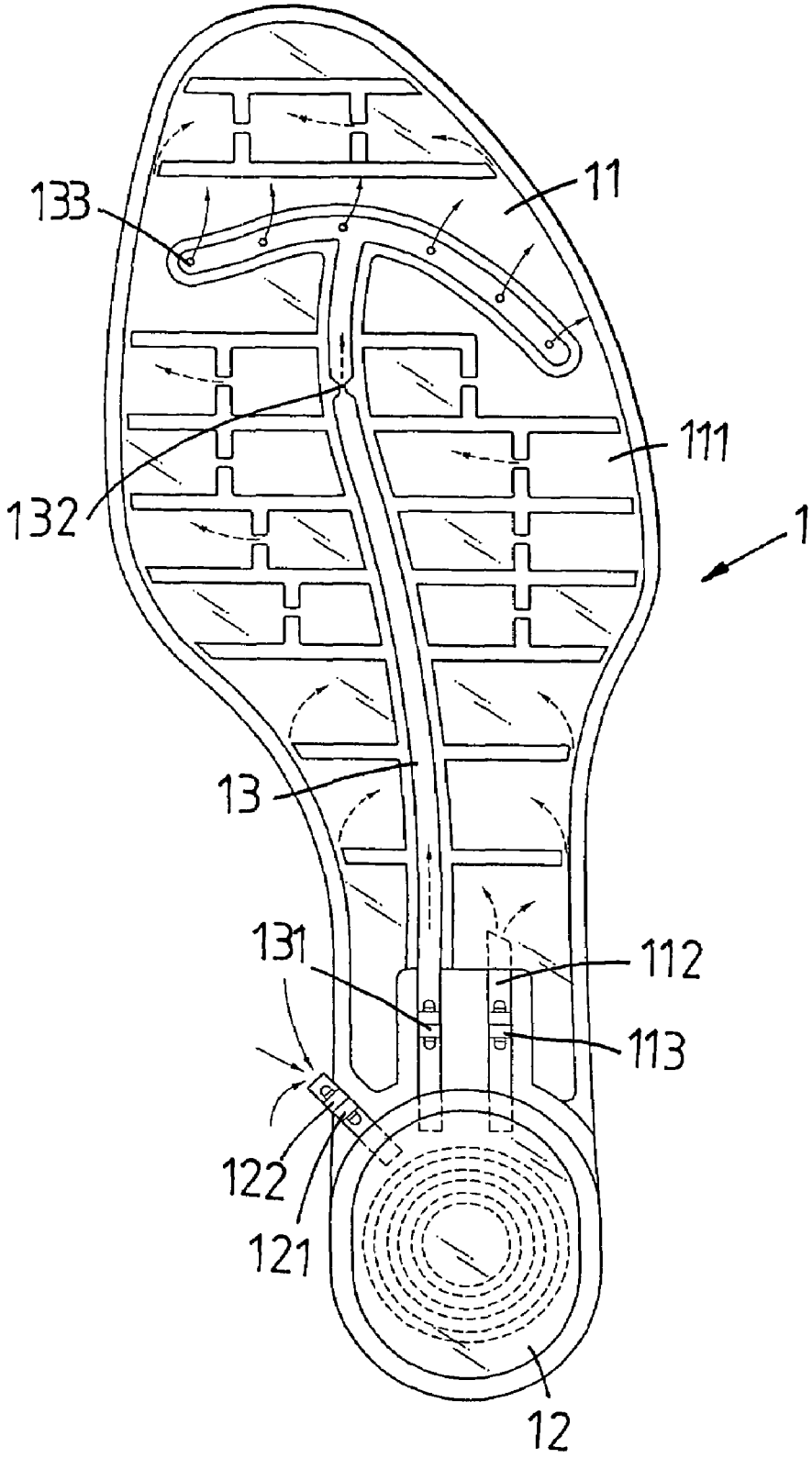
Figure 3:
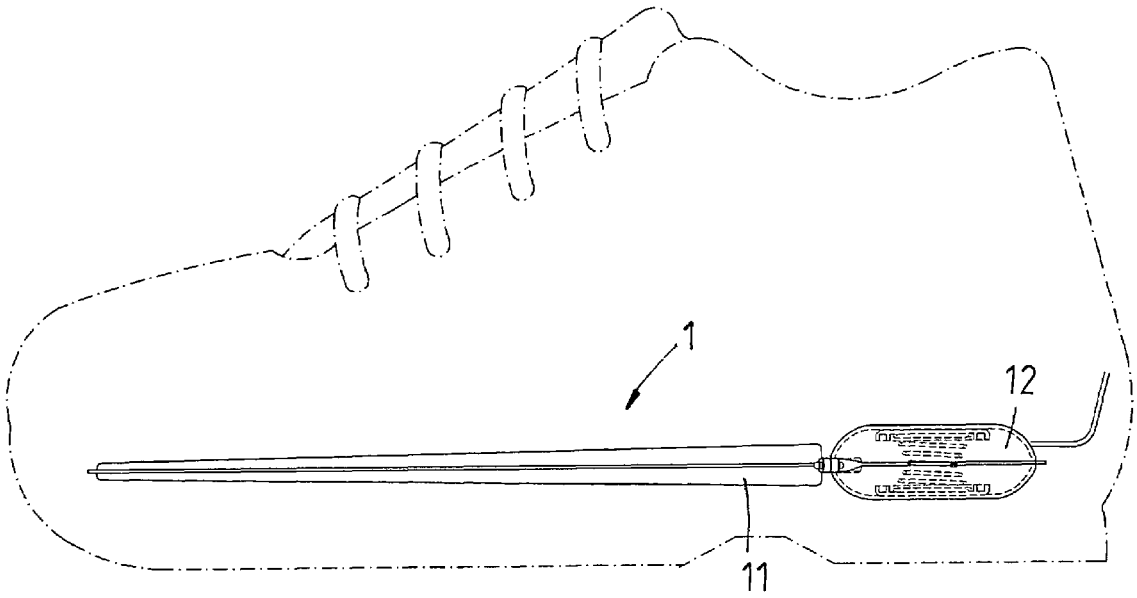
FIG. 3 shows that the inflatable shoe sole of the present invention is located in a shoe.

Referring to FIGS. 1 to 3, the inflatable shoe sole 1 of the present invention comprises a chamber 11 which includes a plurality of sub-chambers 111 which are in communication with each other as shown in FIGS. 1-1 and 1-2. A pumping device 12 is located at the heel portion of the sole 1 and a connection tube 13 which is in communication with the chamber 11 and the pumping device 12. A first valve 131 is received in the connection tube 13 so as to prevent air from flowing back into the pumping device 12. The connection tube 13 is located longitudinally in the shoe sole 1 and an end tube 130 is connected transversely to the distal end of the connection tube 13. A plurality of outlets 133 are defined in the end tube 130 and located corresponding to toes of wearers. A neck portion 132 which defines a narrowed path in the connection tube 13 and is located between the pumping device 12 and the outlets 133.

An inlet tube 121 extends from the pumping device 12 and is located close to a heel portion of the shoe sole 1 so as to introduce air from outside into the pumping device 12. An outlet tube 112 extends from the pumping device 12 and is located in the chamber 11 so as to introduce air from the pumping device 12 into the chamber 11.

Figure 4:
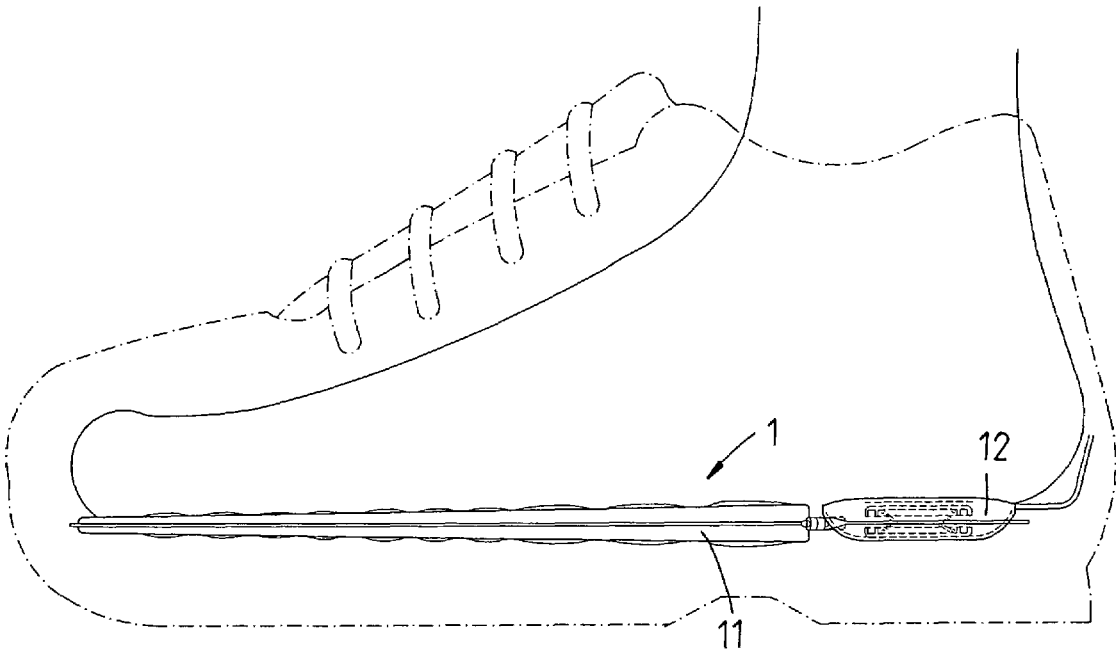
FIG. 4 shows that the inflatable shoe sole of the present invention is inflated in the shoe.
Figure 6:
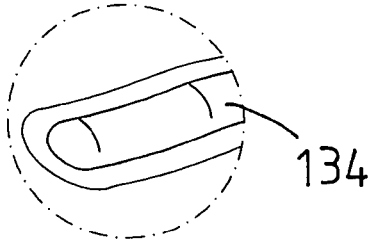
FIG. 6 shows that the outlets are in forms of slits.
Figure 5:
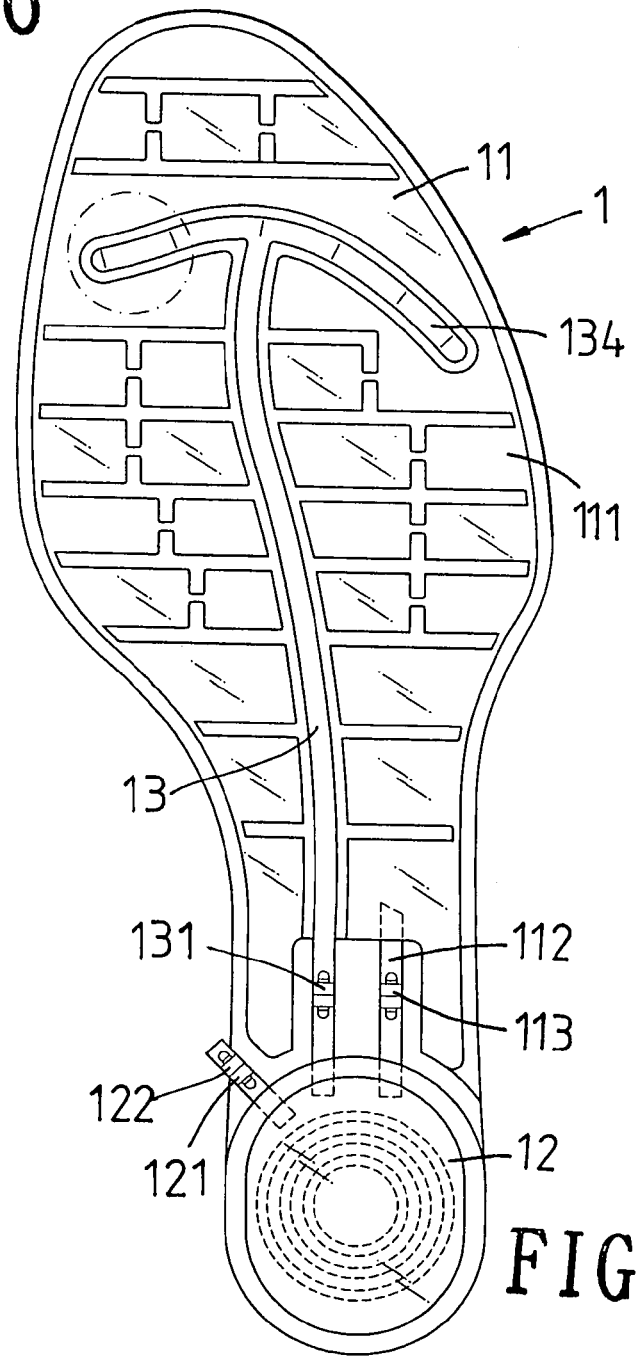
FIG. 5 is a top view of another embodiment of the inflatable shoe sole of the present invention.
Figure 8:
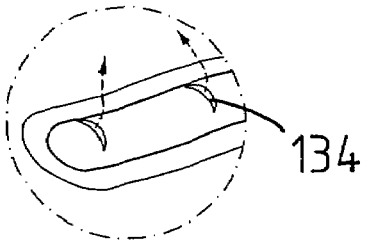
FIG. 8 shows that the slits are opened.
Figure 7:
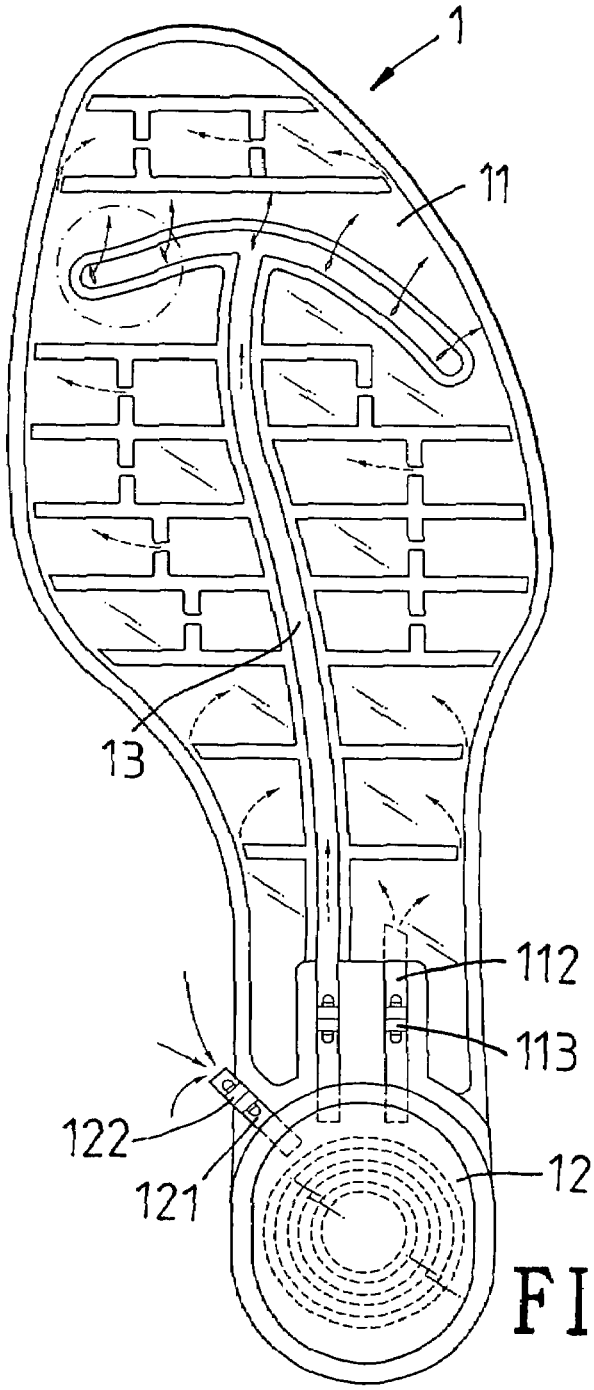
FIG. 7 shows air is introduced into the chamber

When walking or jogging, as shown in FIG. 4, the load of the wearer compresses the pumping device 12 to reduce the pressure in the pumping device 12, and when the heel of the wearer leaves from the pumping device 12, the outside air is sucked into the pumping device 12 via the inlet tube 121. A second valve 122 is located in the inlet tube 121 to restrict the air from flowing out. The air in the pumping device 12 is then pumped out from the outlet tube 112 and enters into the chamber 11. A third valve 113 is located in the outlet tube 112 to prevent the air from flowing back into the pumping device 12. Air in the pumping device 12 is also pumped into the connection tube 13 and will be stopped by the neck portion 132. When the pressure of the air in the connection tube 13 reaches a certain value, the air enters into the end tube 130 via the neck portion 132 and goes out from the outlets 133 to cool the toes of the wearer.

As shown in FIGS. 5-8, the outlets 134 can be made as normal-close slits which is closed normally and can be opened under certain pressure. In this embodiment, the neck portion as disclosed in FIG. 1 is not necessary.

Figure 9:
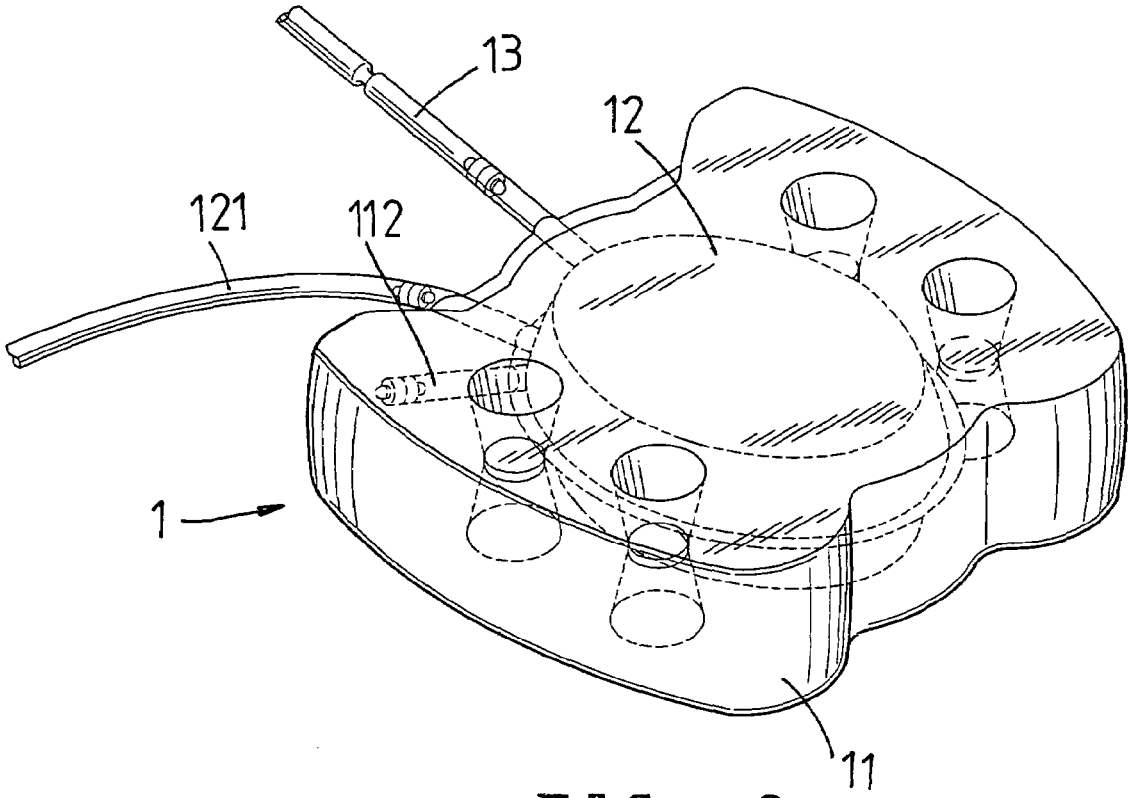
FIG. 9 shows that the pumping device is enclosed by the chamber.
Figure 10:
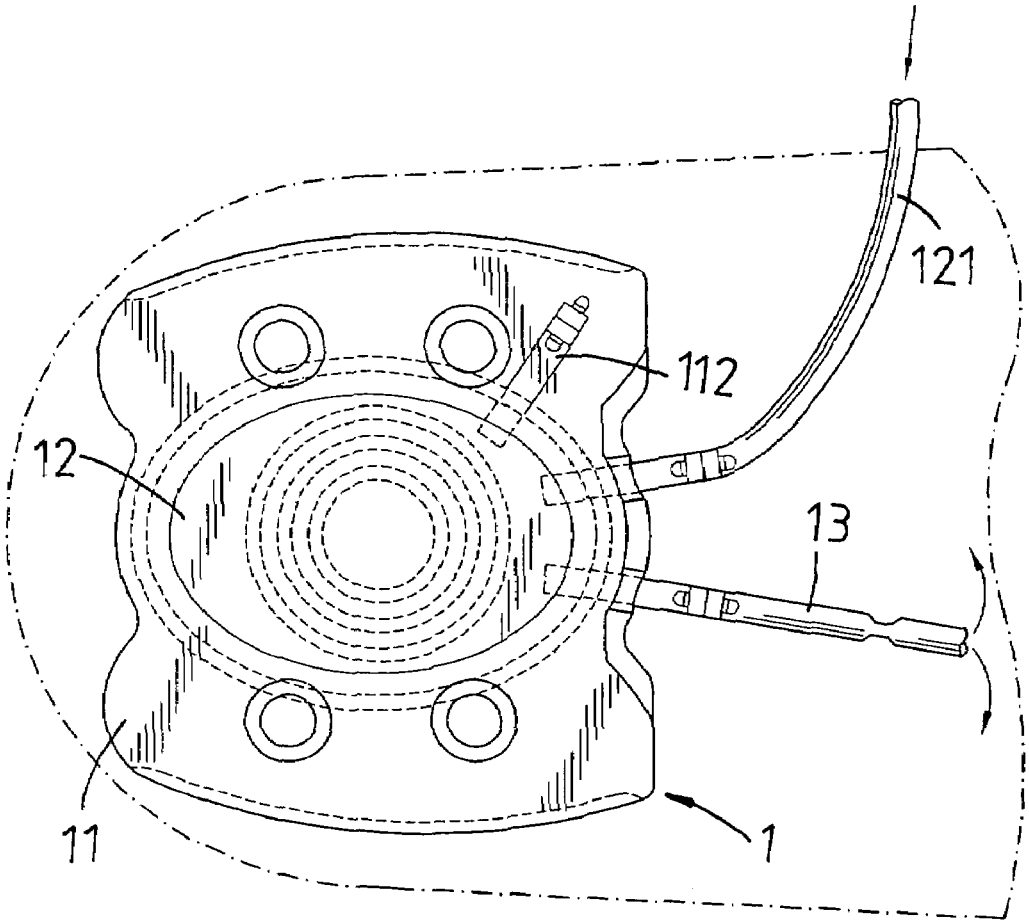
FIG. 10 shows that air enters into the pumping device and then is pumped into the chamber.

FIG. 9 shows that the pumping device 12 can b enclosed by the chamber 11 so that the heel is supported by the inflated chamber 11 and provide extra cushion feature.

Figure 11:
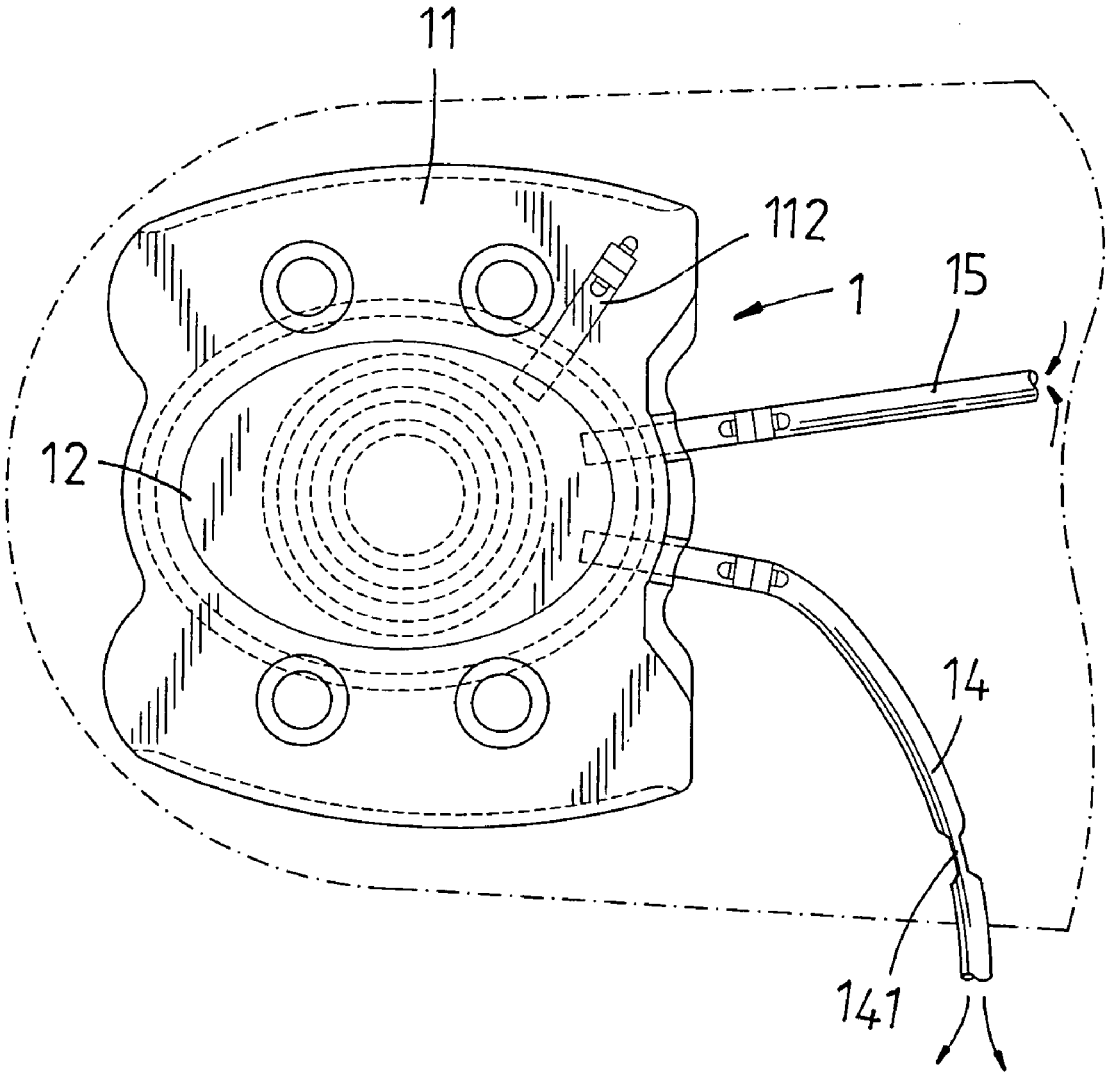
FIG. 11 shows yet another embodiment for heel portion.

FIG. 11 shows yet another embodiment that focuses on the heel portion and includes a pumping device 12 with an outlet tube 112 to introduce air into the chamber 11 around the pumping device 12. A tube 14 extends from the pumping device 12 and includes a neck portion 141. A suction tube 15 extends from the pumping device 12 and sucks air in the shoe and the air is releases from the outlet tube 14. The neck portion 141 in the tube 14 allows the pumping device 12 to pump air into the chamber 11 under certain pressure. The air to be released from the tube 14 is released when the pressure is higher than that in the pumping device 12.

While we have shown and described the embodiment in accordance with the present invention, it should be clear to those skilled in the art that further embodiments may be made without departing from the scope of the present invention.

What is claimed is:

1. A shoe sole (1) comprising:

a chamber (11), a pumping device (12) and a connection tube (13) which is in communication with the chamber (11) and the pumping device (12), the connection tube (13) located longitudinally in the shoe sole and an end tube (130) connected transversely to a distal end of the connection tube (13), a first valve (131) received in the connection tube (13) so as to prevent air from flowing back into the pumping device (12), an inlet tube (121) extending from the pumping device (12) so as to introduce air from outside into the pumping device (12), an outlet tube (112) extending from the pumping device (12) and located in the chamber (11) so as to introduce air from the pumping device (12) into the chamber (11), a plurality of outlets (133) defined in the end tube (130), the outlets (133) located at a front section of the sole and adapted to be located beneath toes of wearer's foot, the connection tube (13) having a neck portion (132) which defines a narrowed path in the connection tube (13), the neck portion (132) located between the pumping device (12) and the outlets (133).

2. The shoe sole as claimed in claim 1, wherein the chamber (11) is composed of sub-chambers (111) which are in communication with each other.

3. The shoe sole as claimed in claim 1, wherein the pumping device (12) is enclosed by the chamber (11).

4. The shoe sole as claimed in claim 1, wherein the inlet tube (121) is located close to a heel portion of the shoe sole (1).

5. The shoe sole as claimed in claim 1, wherein the outlets (134) are normal-close slits.

* * * * *